US006416347B2

(12) United States Patent
Kojima

(10) Patent No.: US 6,416,347 B2
(45) Date of Patent: Jul. 9, 2002

(54) INSULATION-DISPLACEMENT TERMINAL FITTING AND PRODUCTION METHOD THEREFOR

(75) Inventor: Eiji Kojima, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/774,837

(22) Filed: Jan. 31, 2001

(30) Foreign Application Priority Data

Feb. 22, 2000 (JP) ..... 2000-043731

(51) Int. Cl.[7] ..... H01R 11/20; H01R 4/24
(52) U.S. Cl. ..... 439/397
(58) Field of Search ..... 439/397, 399, 439/401, 406, 407, 400, 395, 396

(56) References Cited

U.S. PATENT DOCUMENTS

| | | | | | |
|---|---|---|---|---|---|
| 3,867,005 | A | | 2/1975 | Hoppe, Jr. | |
| 4,040,702 | A | | 8/1977 | McKee et al. | |
| 4,210,379 | A | * | 7/1980 | Vachhani et al. | 339/101 |
| 4,344,664 | A | * | 8/1982 | Walkup | 339/99 |
| RE31,132 | E | * | 1/1983 | Hoppe, Jr. | 339/97 |
| 4,472,596 | A | * | 9/1984 | Brown et al. | 174/84 |
| 5,163,855 | A | * | 11/1992 | Gerke et al. | 439/709 |
| 5,399,098 | A | * | 3/1995 | Marshall et al. | 439/398 |
| 5,441,422 | A | * | 8/1995 | Steiner | 439/395 |
| 5,683,266 | A | * | 11/1997 | Guidi et al. | 439/395 |
| 5,769,654 | A | * | 6/1998 | Onoda | 439/393 |
| 5,980,300 | A | * | 11/1999 | Okabe | 439/397 |
| 6,012,942 | A | * | 1/2000 | Volstorf | 439/397 |
| 6,019,626 | A | * | 2/2000 | Abe | 439/399 |
| 6,033,255 | A | * | 3/2000 | Murofushi | 439/397 |
| 6,077,103 | A | * | 6/2000 | Saka et al. | 439/397 |
| 6,080,005 | A | * | 6/2000 | Aoyama et al. | 439/397 |
| 6,113,417 | A | * | 9/2000 | Furutani et al. | 439/397 |
| 6,142,819 | A | * | 11/2000 | Norizuki et al. | 439/397 |
| 6,155,865 | A | * | 12/2000 | Abe | 439/397 |
| 6,176,731 | B1 | * | 1/2001 | Aoyama et al. | 439/399 |
| 6,203,360 | B1 | * | 3/2001 | Harting et al. | 439/412 |

FOREIGN PATENT DOCUMENTS

| | | |
|---|---|---|
| EP | 0 320 310 | 6/1989 |
| EP | 0 722 197 A2 | 7/1996 |
| GB | 1 585 345 | 2/1981 |
| JP | 9-274941 | 10/1997 |

OTHER PUBLICATIONS

US 4,057,314, 11/1977, Mathe et al. (withdrawn)

* cited by examiner

*Primary Examiner*—P. Austin Bradley
*Assistant Examiner*—Edwin A. León
(74) *Attorney, Agent, or Firm*—Anthony J. Casella; Gerald E. Hespos

(57) ABSTRACT

An insulation-displacement terminal includes blades (12) that project inwardly from opposed side walls (14). Each blade (12) has V-shaped edges (12A) and a contact edge (12B). The V-shaped edges (12A) are inclined to guide wire a (W) from the side walls (14) toward the contact edges (12B) when viewed in the longitudinal direction of the wire (W). A hook (15) is formed at an end of each V-shaped edge (12A) toward the corresponding contact edge (12B). Thus, even if an angle of inclination of the V-shaped edges (12A) with respect to a wire pushing direction is made smaller, the resin coating (Wa) of the wire (W) can be securely cut open by the hooks (15).

5 Claims, 9 Drawing Sheets

(A)

(B)

INSULATION-DISPLACEMENT TERMINAL FITTING AND PRODUCTION METHOD THEREFOR

BACKGROUND OF THE INVENTION

1. Field of the Invention

The present invention relates to an insulation-displacement terminal fitting and to a method for producing the same.

2. Description of the Related Art

A known insulation-displacement terminal fitting is disclosed in Japanese Unexamined Patent Publication No. 8-241740. This terminal fitting includes inward facing blades formed on a pair of side walls. The blades are formed by embossing portions of the side walls inwardly to project in V-shape when viewed in a direction in which a wire is pushed. A resin coating of a wire pushed between the blades is cut by the edges of the V-shaped blades and a core of the wire then contacts the projecting ends of the blades.

Insulation displacement terminal fittings with blades that project inwardly from side walls, including the terminal fitting disclosed in JP 8-241740, have a pair of V-shaped edges that are inclined to approach each other in a wire pushing direction to guide a wire into a proper position between the blades. A smaller angle between the inclinations of the V-shaped edges and the wire pushing direction provides a better guiding function because the wire is less likely to get caught. However, if this angle is too small, the wire may merely be deformed elastically as it is pushed between contact edges of the blade portions without the resin coating of the wire being cut. Thus, the blade portions and a core of the wire may not contact each other.

In view of the above, an object of the present invention is to securely cut a resin coating of a wire without impairing a function of guiding the wire to between blades.

SUMMARY OF THE INVENTION

The invention is directed to an insulation displacement terminal fitting with a pair of side walls and at least one pair of blades provided respectively on the side walls for connection with a wire. Each blade comprises a projecting end that acts as a contact edge, and cutting edges for cutting an insulation coating of the wire pushed between a pair of blades to bring a core of the wire into contact with the contact edge. The cutting edges are inclined to guide the wire from the side walls to the contact edge when viewed from the longitudinal direction of the wire. At least one hook edge is formed at ends of the cutting edges toward the contact edge. Preferably, the hook edge is aligned to project toward the wire being pushed between the blades According to a preferred embodiment, the blades are formed to project in a substantially V-shape when viewed in a pushing direction of the wire by bending or embossing portions of the side walls inwardly. Most preferably, the cutting edges are substantially V-shaped.

The hook edges are formed at the ends of the V-shaped edges toward the contact edges and project toward the wire. Thus, the resin coating of the wire can be cut securely by the hook edges even if the angle of inclination of the V-shaped edges is made smaller to facilitate guiding of the wire. In other words, both the function of guiding the wire from the side walls toward the contact edges and the function of securely cutting the resin coating can be realized.

Preferably, each hook edge has a pointed shape of a substantially right angle or acute angle when viewed in the longitudinal direction of the wire or the longitudinal direction of the terminal fitting. The pointed shape enables the hook edges to bite into the resin coating securely and to cut it open.

Each hook edge preferably is formed to be substantially continuous and flush with the corresponding contact edge when viewed in the longitudinal direction of the wire. Thus, an embossing step to cause the hook edge to project inwardly or outwardly with respect to the contact edge is unnecessary.

Each hook edge is formed to be continuous with and arranged at an obtuse angle with respect to the cutting edges of the blades.

The side walls preferably include depressed portions or valley-shaped areas that will become the substantially V-shaped cutting edges. These depressed portions are punched or cut out to have an arcuate or trapezoidal shape before the side walls are bent. The hook edges then are formed by bending or embossing the arcuate or trapezoidal depressed portions. Since the portions which will become the hook edges are punched out to have an arcuate or trapezoidal shape, a punching die can be formed more easily as compared to a case where the hooks are punched out in V-shape.

The invention also is further directed to a method for producing an insulation displacement terminal fitting for connection with a wire. The method comprises providing a terminal material. The method then comprises shaping the terminal material to provide at least one pair of blades at side walls of the terminal fitting for connection with the wire. The method then continues by forming the blades with projecting ends that function as contact edges, and cutting edges for cutting an insulation coating of the wire pushed between the blades to bring a core of the wire into contact with the contact edges. The cutting edges are formed to be inclined to guide the wire from the side walls to the contact edges when viewed from the longitudinal direction of the wire. The method also includes forming hook edges at ends of the cuffing edges toward the contact edges.

According to a further preferred embodiment, the method further comprises punching or cutting out valley-shaped depressed edges on areas of the side walls that will become the blades. The valley-shaped depressed edges have arcuate or trapezoidal shapes before the side walls are bent. The method concludes by bending the portions of the side walls adjacent the arcuate or trapezoidal depressed edges to form the cutting edges, the hook edges and the contact edges.

These and other objects, features and advantages of the present invention will become apparent upon reading of the following detailed description of preferred embodiments and accompanying drawings.

SUMMARY OF THE INVENTION

Figure 6:
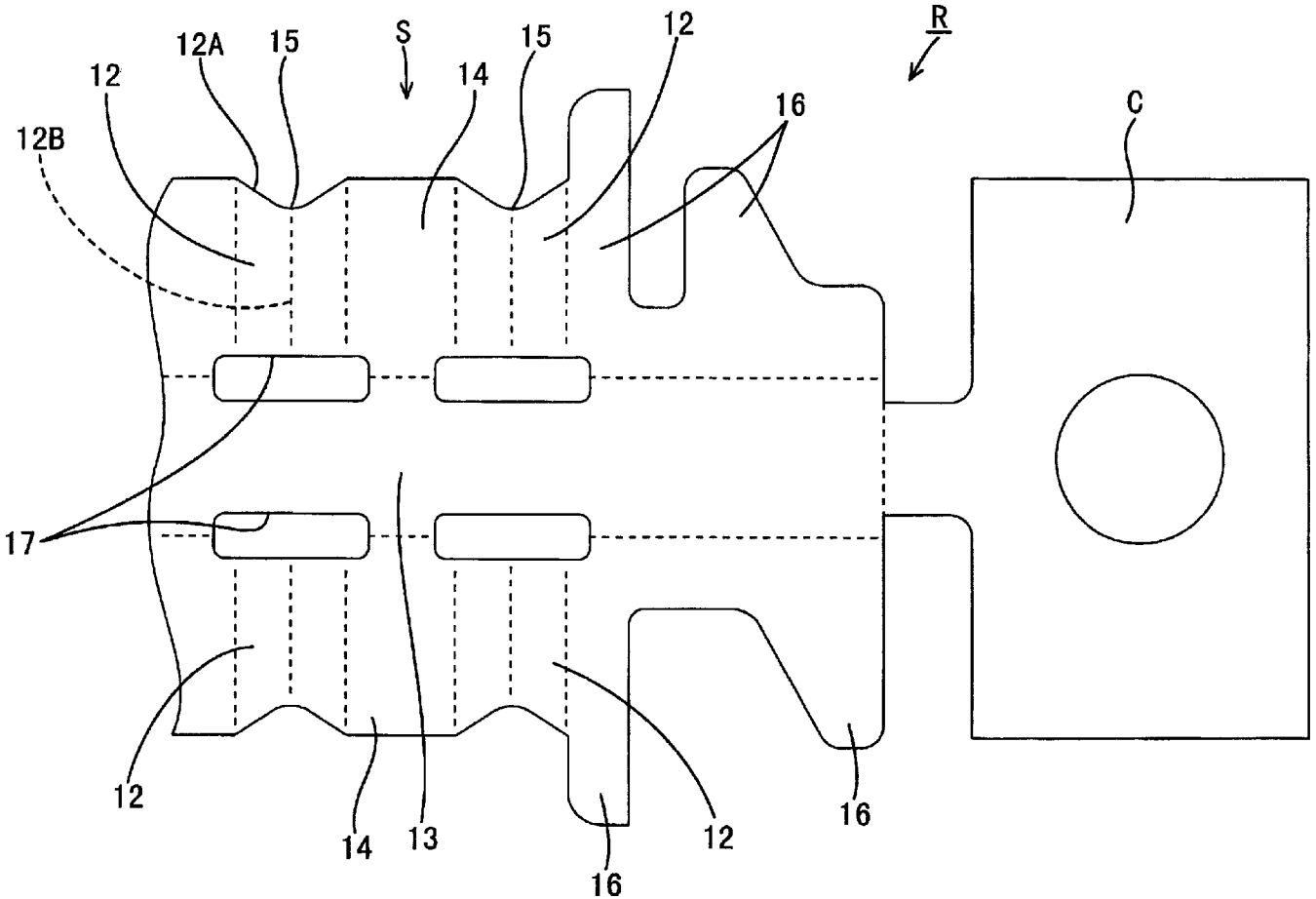
FIG. 6 is a partial development of the insulation-displacement terminal fitting.
Figure 7:
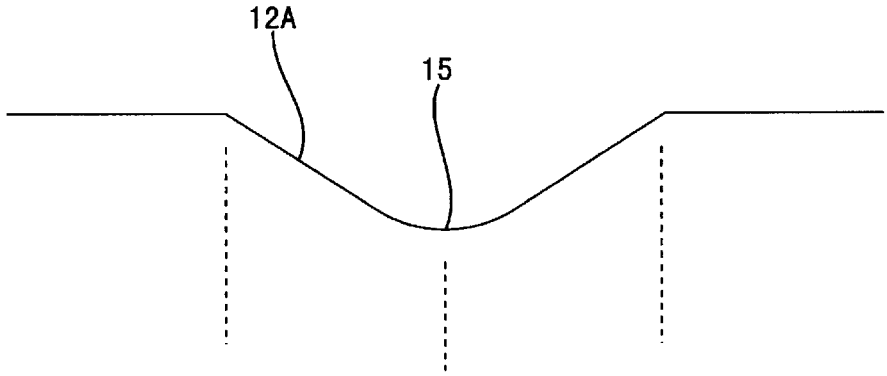
Figure 7:
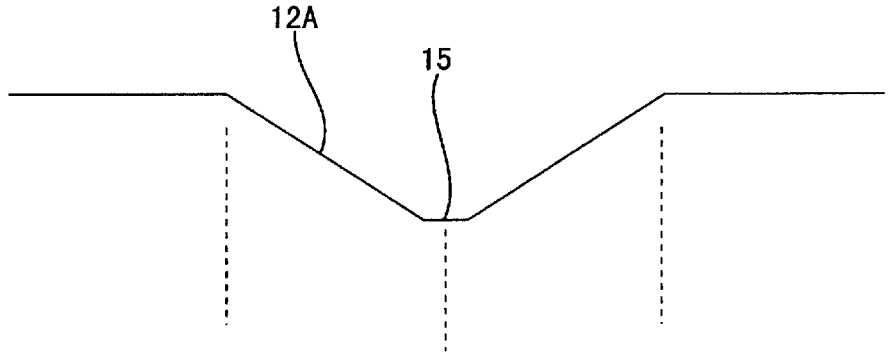

FIGS. 7(A) and 7(B) are partial enlarged views of FIG. 6.

FIGS. 8(A) to 8(E) are schematic partial views of hooking portions according to some further preferred embodiments of the invention.

DETAILED DESCRIPTION OF THE PREFERRED EMBODIMENT

Insulation-displacement terminal fittings T of this embodiment are produced from chained terminals R in which a carrier C connects a multitude of substantially plate-shaped terminal blanks S. The blanks S are stamped or cut out in a specified shape and then are formed by bending, deforming, and/or embossing into a specified configuration. The blanks S or terminal fittings T are detached from the carrier C prior to mounting in a connector.

Figure 1:
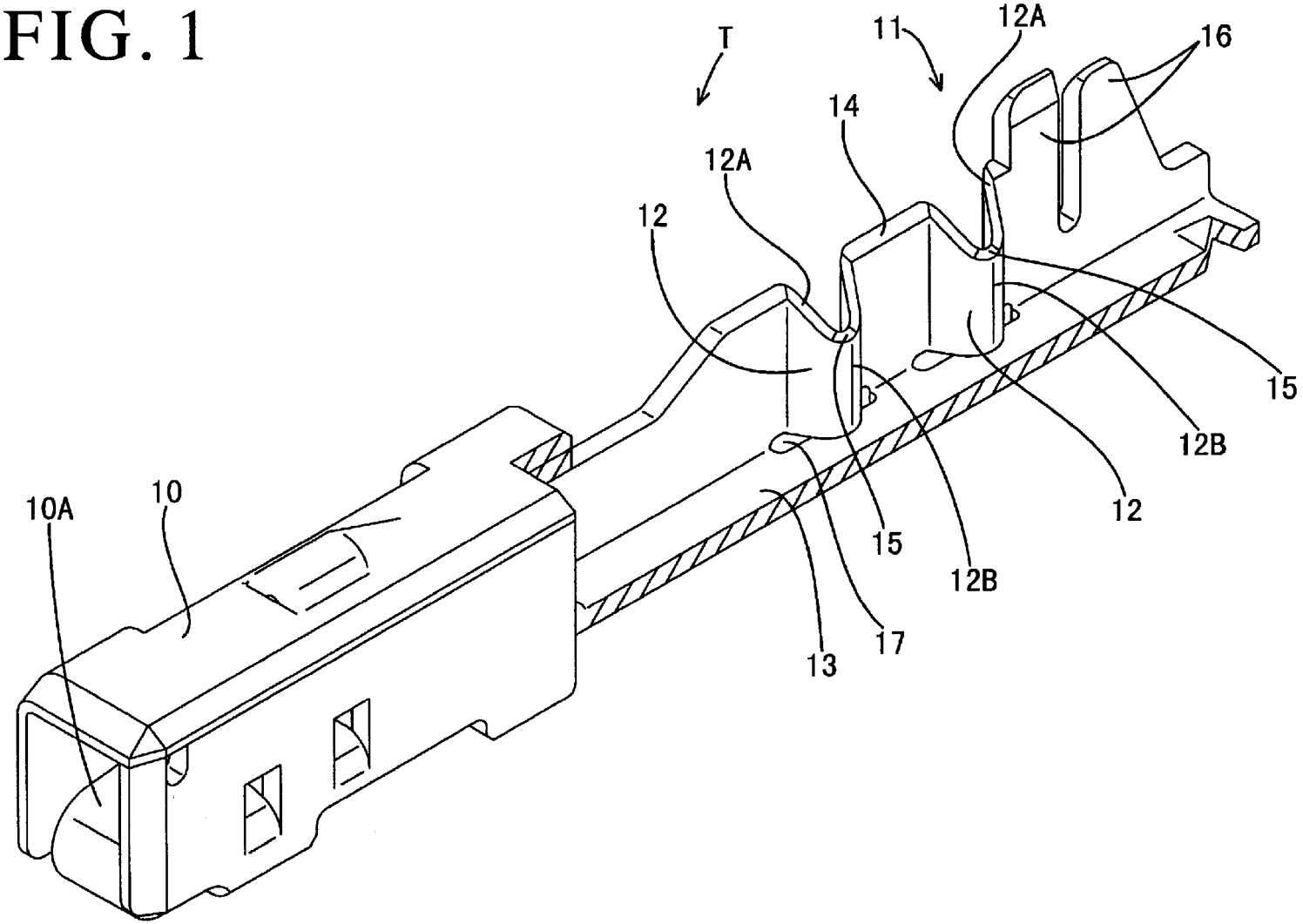
FIG. 1 is a perspective view partly cut away of an insulation-displacement terminal fitting according to one embodiment of the invention.
Figure 2:
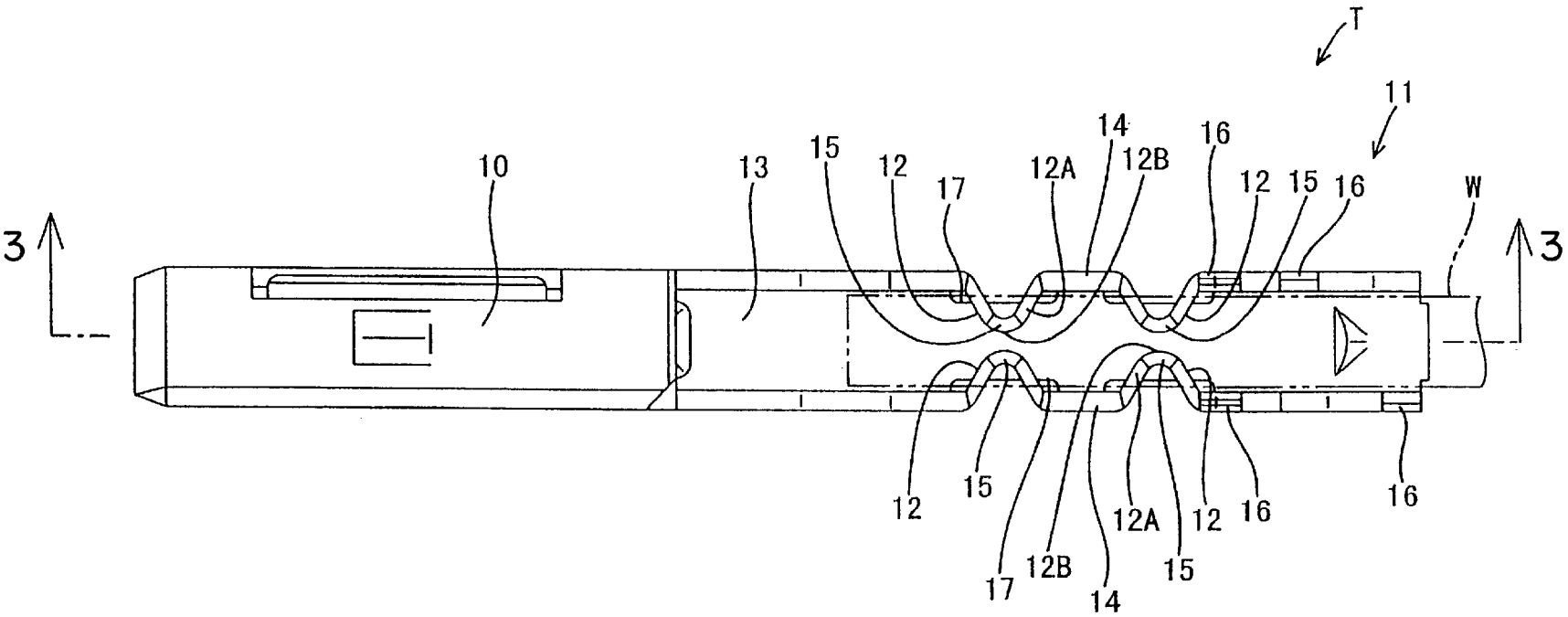
FIG. 2 is a plan view of the insulation-displacement terminal fitting.
Figure 3:
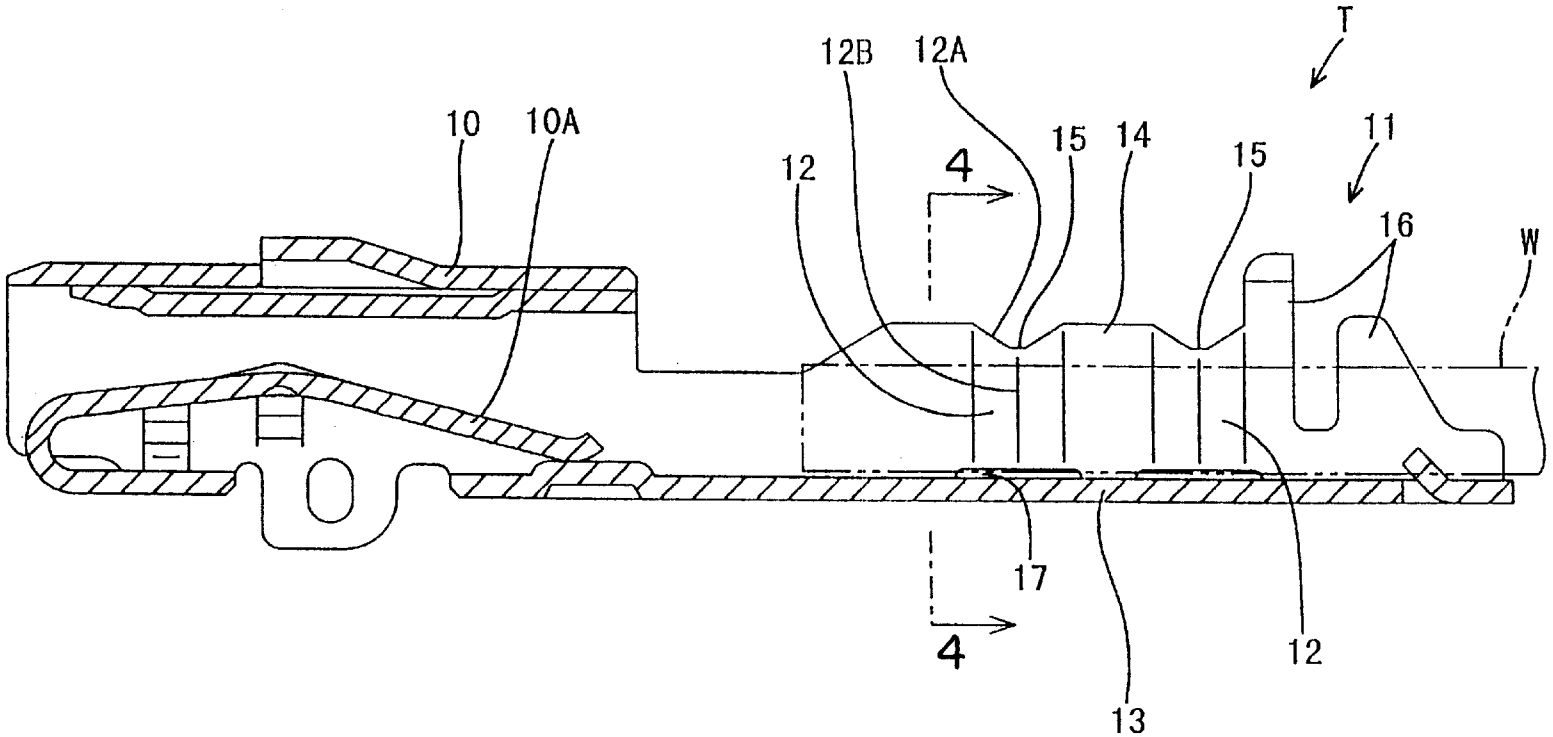
FIG. 3 is a section along X—X of FIG. 2.
Figure 4:
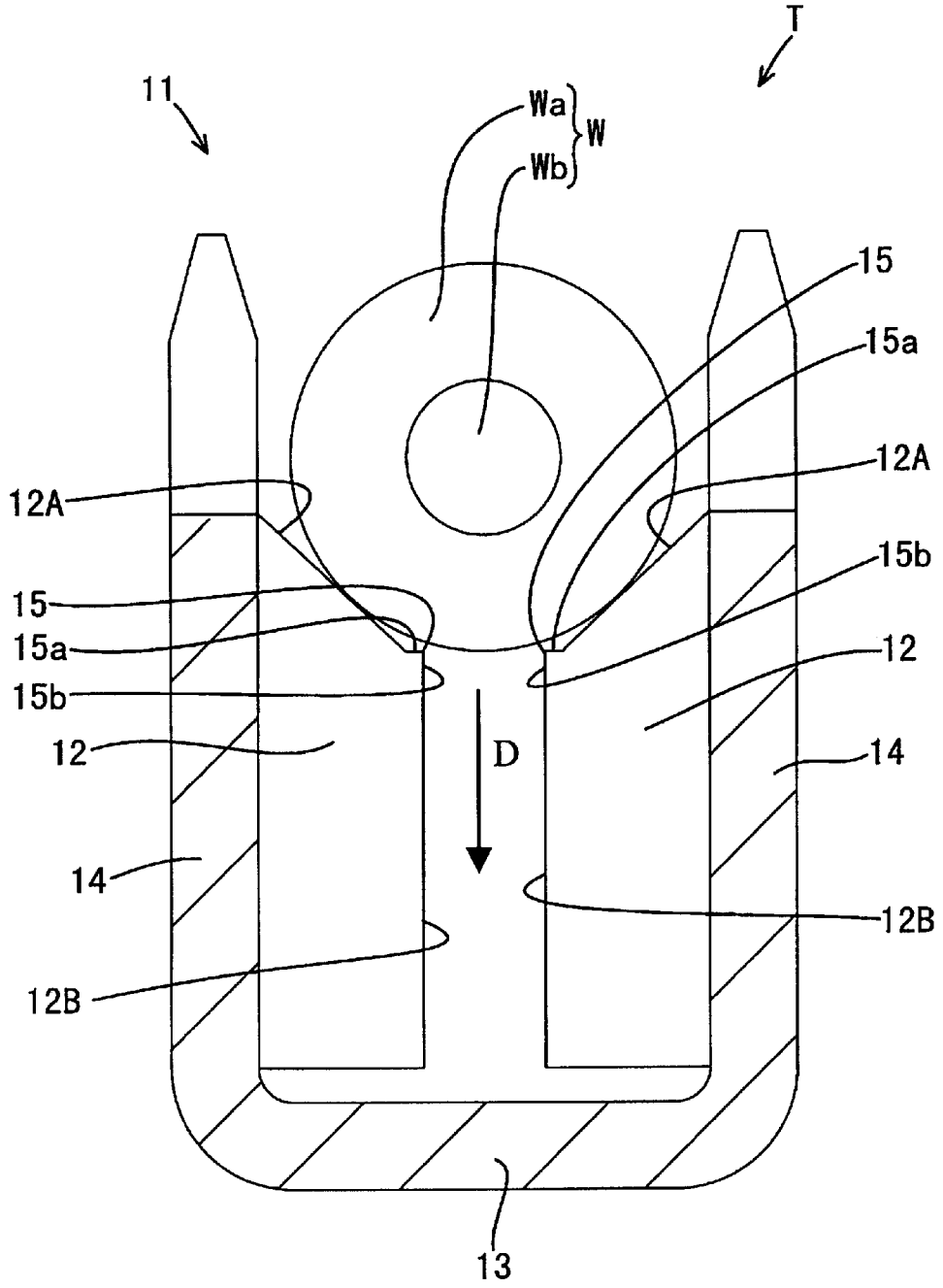
FIG. 4 is a section along Y—Y of FIG. 3.
Figure 5:
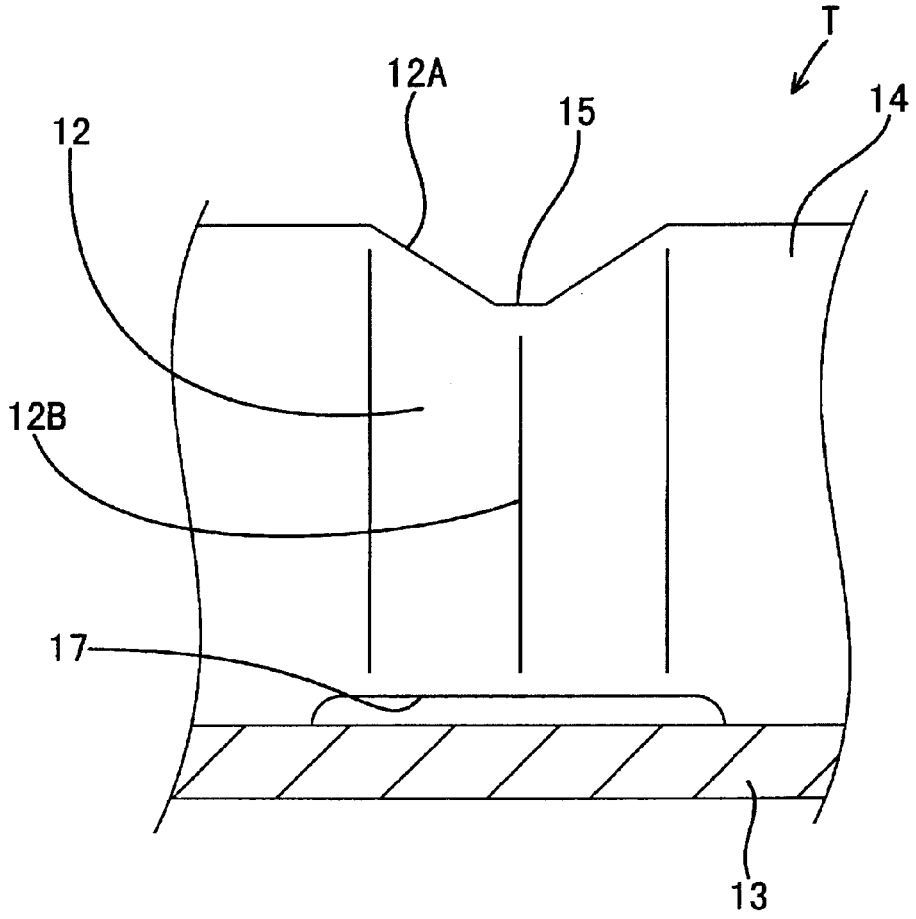
FIG. 5 is a partial enlarged view of FIG. 3.

It should be noted that the left side in FIGS. 2 and 3 is referred to as the front, and the vertical direction is based on the orientation in FIGS. 3 to 5.

The insulation-displacement terminal fitting T is substantially narrow along forward and backward or longitudinal directions and has opposite front and rear ends. A fitting portion 10 extends rearward from the front end and is configured for mating with a male terminal fitting (not shown). The fitting portion 10 in this embodiment has a substantially rectangular box-shape with open front and rear ends. A substantially triangularly bent elastic contact piece 10A is provided in the fitting portion 10.

A connection portion 11 extends forward from the rear end of the insulation displacement terminal fitting T and is configured for connection with a wire W. The connecting portion 11 is comprised of blades 12 and crimping pieces 16.

The terminal fitting T includes a bottom wall 13 and a pair of side walls 14 that extend perpendicularly up from opposite sides of the bottom wall 13. Thus a wire-insertion space is defined between the side walls 14. The blades 12 are formed by bending, deforming and/or embossing portions of the side walls 14 into the wire-insertion space to define a substantially V-shape when viewed from above in a pushing or inserting direction D of a wire W during insulation displacement. Thus, each blade 12 comprises two intersecting panels Opposed left and right blades 12 make a pair, and two pairs of blades 12 are provided one after the other in this embodiment.

The upper edge of each blade 12 is referred to as a cutting edge 12A or a substantially V-shaped edge 12A, and a projecting edge is referred to as a contact edge 12B. The contact edge 12B effectively defines a fold line between two intersecting panels of the blade 12. The contact edge 12B is aligned approximately parallel to the side walls 14 and parallel to the pushing or insertion direction D of the wire W into the wire-insertion space. The V-shaped edges 12A in each pair of blades are inclined and converge to guide the wire W from the side walls 14 toward the contact edges 12B or toward a central portion of the wire-insertion space of the terminal fitting T. Thus the wire W is guided to a proper contact position between the blades 12 by the inclinations of the left and right V-shaped edges 12A.

The wire W is pushed between the blades substantially along the insertion direction D for connection while being oriented such that the longitudinal axis of the wire W extends substantially in forward and backward or longitudinal directions. The wire W is guided during insulation displacement to a center position (proper contact position) with respect to a transverse direction by the inclinations of the V-shaped edges 12A. A resin or other insulation coating Wa of the wire W then is cut by the V-shaped edges 12A, and the contact edges 12B bite into the cuts made in the resin coating Wa to contact a core Wb of the wire W.

The wire W is less likely to get caught by the V-shaped edges 12A and more likely to slide along the V-shaped edges 12A when the angle of inclination of the V-shaped edges 12A with respect to the wire pushing or vertical direction D becomes small, as shown by the steeper inclination in FIG. 4. Thus, a guiding function is improved. However, such a steep inclination disadvantageously reduces a function of cutting the resin coating Wa by the V-shaped edges 12A. Conversely, the resin coating Wa of the wire W is more likely to get cut if the angle of inclination of the V-shaped edges 12A is made larger to moderate the inclination as shown in FIG. 4. However such a moderate inclination will degrade the guiding function.

A hook edge 15 is formed at an end (leading upper end of each blade 12) of each V-shaped edge 12A toward the contact edge 12B or in a portion on the blade 12 between the cutting or substantially V-shaped edge 12A and the contact edge 12B to cut the resin coating Wa without impairing the guiding function. As shown in FIG. 4, the hook edge 15 is formed to project toward the wire W being pushed between the blades 12. When viewed in the longitudinal direction of the wire W, the hook edge 15 has a pointed shape of a substantially right angle formed between a vertical line 15*b* and a horizontal line 15*a*. The vertical line 15*b* of the hook edge 15 is substantially continuous and flush with the corresponding contact edge 12B. However, the horizontal line 15*a* is substantially continuous with the corresponding inclined V-shaped edge 12A at an obtuse angle thereto. The obtuse angle preferably is between 100° and 170°, and more preferably between 120° and 150°.

The crimping pieces 16 of the connecting portion 11 are formed to extend up from the left and right ends of the bottom wall 13 behind the blades 12, and are crimped into connection with the wire W mounted between the blades 12.

Slits 17 are formed along boundaries between the bottom wall 13 and the side walls 14 over a forming area of the respective blades 12. Thus the blades 12 can be embossed into a V-shape without deforming the bottom wall 13.

The respective terminal fittings T are formed by stamping the blanks S on the carrier C in the chained terminals R as shown in FIG. 6. At this time, the side walls 14 of the connecting portion 11 are still substantially flush with the bottom wall 13. The blades 12 then are formed by bending portions of the side walls 14 substantially into a V-shape. The blades 12 also are formed with the V-shaped edge 12A and the hook edge 15. The substantially V-shaped edge 12A may have an arcuate depressed portion, as shown in FIG. 7(A) or trapezoidal depressed portion as shown in FIG. 7(B). If the depressed portion is triangular, then the V-shaped edge 12 is substantially straight from the side wall 14 to the contact edge 12B when viewed in the longitudinal direction of the wire W, and there is no hook edge 15. The hook edge 15 is formed by embossing the terminal blank S that has the arcuate or trapezoidal depressed portion.

The arcuate or trapezoidal depressed portion that defines the V-shaped edges 12A and the hook edge 15 is formed when the terminal blanks S are punched out with a punching die (not shown). A punching die with this shape is unlikely to be abraded, as compared to a case where the leading end of the die is pointed. Thus, the die to form the V-shaped edges 12A with the hooks 15 has advantages independent of the resulting terminal fitting T.

The wire W is pushed between the left and right blades 12 from above so that the wire W comes into contact with the V-shaped edges 12A. At this time, even if the wire W is transversely displaced from the center between the blades 12, the position of the wire W is corrected to the center by the inclinations of the transversely symmetrical V-shaped edges 12A. The insulation or resin coating Wa is cut by the V-shaped edges 12A, as the wire W is further pushed in. At this stage, if the angle of inclination of the V-shaped edges 12A with respect to the wire pushing direction is small, the resin coating Wa may only slide on the V-shaped edges 12A, and consequently the wire W may be held between the contact edges 12B while being deformed without cutting the resin coating Wa. However, the hook edges 15 project obliquely from below and toward the wire W at the inner ends of the V-shaped edges 12A. Thus, the hook edges 15 bite into the resin coating Wa to cut it open. Further, the hook edges 15 are between the substantially V-shaped edge 12A and the contact edge 12B. Additionally, the hook edges 15 have a pointed shape preferably of a substantially right angle. Therefore the hook edges 15 can securely pierce into the resin coating Wa.

As described above, the hook edges 15 project toward the wire W being pushed in and are formed at the ends of the V-shaped edges 12A toward the contact edges 12B. Accordingly, the resin coating Wa of the wire W can be cut securely by the hook edges 15 even if the angle of inclination of the V-shaped edges 12A is made smaller to facilitate guiding the wire W. In other words, the function of guiding the wire W from the side walls 14 toward the contact edges 12B and the function of securely cutting the resin coating Wa both can be realized.

The hook edges 15 have a pointed shape of a substantially right angle. Thus the hook edges 15 can securely bite into the resin coating Wa to cut it open even if the hook edges 15 contact the resin coating Wa in a direction oblique to the wire pushing direction.

Each hook edge 15 is formed such that the vertical line 15*b* that contours the hook edge 15 is continuous and flush with the contact edge 12B when viewed in the longitudinal direction of the wire W. Thus, the blade 12 can be formed merely by embossing a portion of the side wall 14 into V-shape, obviating the need for an embossing step for causing the hook 15 to project inwardly or outwardly with respect to the contact edge 12B. It should be noted that no special processing is necessary since the horizontal line 15*a* of the hook edge 15 is substantially continuous with the V-shaped edge 12A and can be formed in the step of punching the terminal blank S out by a press.

The valley-shaped depressed portions of the side walls 14 which will become the V-shaped edges 12A, i.e. the portions which will become the hook edges 15, are punched to have an arcuate or trapezoidal shape in a development of the side walls 14 before bending. Thus, the punching die can be formed more easily as compared to a case where the hook edges 15 are punched into a V-shape.

The present invention is not limited to the above described illustrated embodiment. For example, following embodiments are also embraced by the technical scope of the present invention as defined in the claims. Besides them, various changes can be made without departing from the scope and sprit of the present invention as defined in the claims.

Although the upper surface of each hook edges is at a right angle to the corresponding contact edge in the foregoing embodiment, it may be at an acute angle thereto according to the present invention. In such a case, the V-shaped edge and the upper surface of the hook edge form a valley-shaped contour when viewed in the longitudinal direction of the wire (FIG. 8(A)).

Although the upper surface of each hook edge is at an obtuse angle to the corresponding V-shaped edge in the foregoing embodiment, it may be arcuately continuous with the V-shaped edge according to the present invention. In such a case, the entire upper surface of the hook edge may be arcuate or the leading end (toward the contact edge) of the hook edge may be flat when viewed in the longitudinal direction of the wire (FIG. 8(B)).

Figure 8:
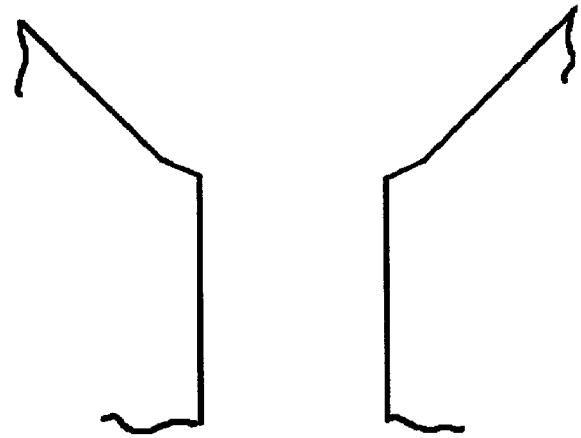
Figure 8:
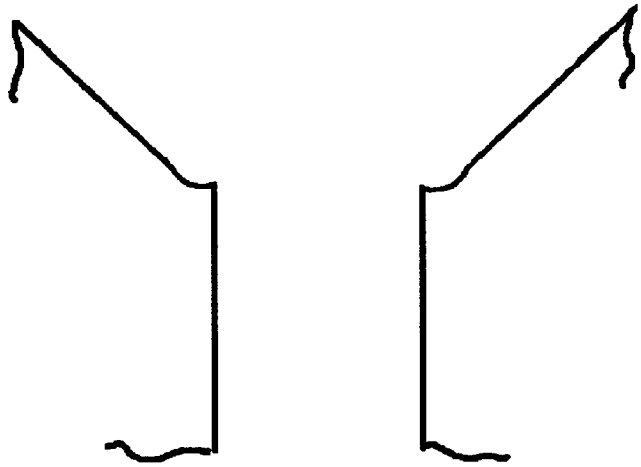
Figure 8:
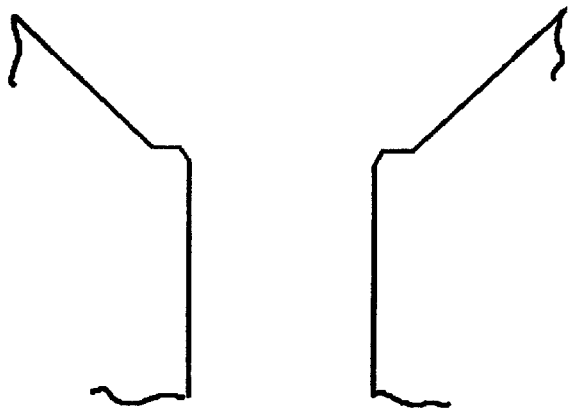
Figure 8:
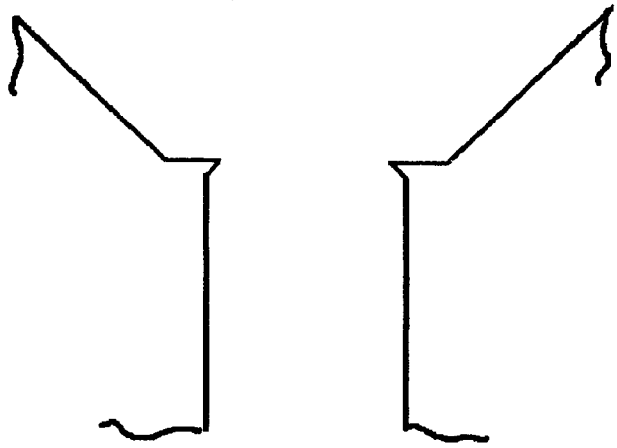
Figure 8:
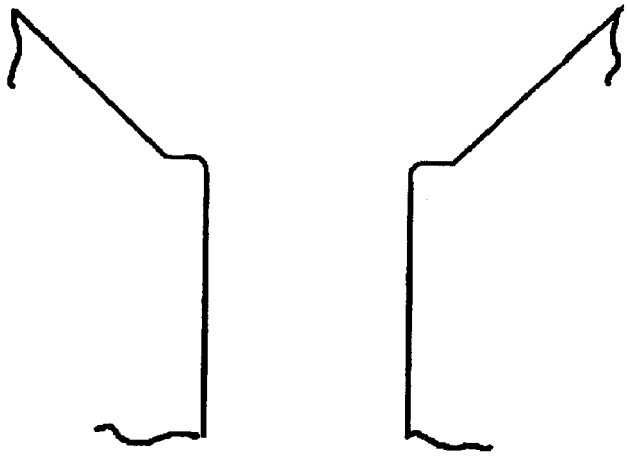

Although part of each hook edge is continuous and flush with the corresponding contact edge when viewed in the longitudinal direction of the wire in the foregoing embodiment, the hook edge may be inclined inwardly (FIG. 8(C)) or outwardly (FIG. 8(D)) with respect to the contact edge according to the present invention.

Although the projecting end of the hook edge has a pointed shape of a right angle when viewed in the longitudinal direction of the wire in the foregoing embodiment, it may be arcuate according to the present invention (FIG. 8(E)).

What is claimed is:

1. An insulation-displacement terminal fitting, comprising: a bottom wall having opposite sides, a pair of side walls extending upward from the respective sides of the bottom wall such that a wire-insertion space is defined between the side walls, at least one blade extending from each said side wall into the wire-insertion space, each said blade being substantially V-shaped and having first and second panels meeting at a contact edge spaced from the respective side wall, cutting edges facing away from the bottom wall being formed on the panels of each said blade, the cutting edges being aligned to be furthest from the bottom wall at locations closest to the respective side wall, a hook edge being formed on each said blade between the contact edge and the cutting edges, the hook edge aligned to the cutting edges at an obtuse angle.

2. The insulation-displacement terminal fitting of claim 1, wherein each said hook edge is substantially normal to the respective contact edge.

3. The insulation-displacement terminal fitting of claim 1, wherein each said hook edge is aligned to the respective contact edge at an acute angle.

4. The insulation-displacement terminal fitting of claim 1, wherein each said hook edge is substantially parallel to the bottom wall.

5. The insulation-displacement terminal fitting of claim 4, wherein each said contact edge is substantially normal to the bottom wall.

* * * * *